United States Patent [19]

Takenaka et al.

[11] Patent Number: 4,723,891

[45] Date of Patent: Feb. 9, 1988

[54] VARIABLE DISPLACEMENT WOBBLE PLATE TYPE COMPRESSOR WITH IMPROVED CRANKCASE PRESSURE CONTROL SYSTEM

[75] Inventors: Kenji Takenaka; Shinichi Suzuki; Hiroaki Kayukawa; Masaki Ohta, all of Kariya, Japan

[73] Assignee: Kabushiki Kaisha, Toyoda Jidoshokki Seisakusho, Aichi, Japan

[21] Appl. No.: 36,026

[22] Filed: Apr. 8, 1987

[30] Foreign Application Priority Data

Apr. 9, 1986 [JP] Japan ..... 61-081434

[51] Int. Cl.[4] ..... F04B 1/26; F04B 49/00

[52] U.S. Cl. ..... 417/222; 417/270

[58] Field of Search ..... 417/222, 270

[56] References Cited

U.S. PATENT DOCUMENTS

| | | | |
|---|---|---|---|
| 4,674,957 | 6/1987 | Ohta et al. | 417/222 |
| 4,685,866 | 8/1987 | Takenaka et al. | 417/222 |
| 4,687,419 | 8/1987 | Suzuki et al. | 417/222 |

FOREIGN PATENT DOCUMENTS

| | | | |
|---|---|---|---|
| 3645581 | 7/1986 | Fed. Rep. of Germany | 417/222 |
| 3609058 | 10/1986 | Fed. Rep. of Germany | 417/222 |

*Primary Examiner*—William L. Freeh

*Attorney, Agent, or Firm*—Burgess, Ryan & Wayne

[57] ABSTRACT

A variable displacement wobble plate type compressor with a variable angle non-rotary wobble plate, having a suction chamber for refrigerant before compression, a discharge chamber for a compressed refrigerant, suction and compression cylinder bores, pistons reciprocated by the wobble plate within the cylinder bores for compressing the refrigerant, a crankcase with a chamber to receive therein a drive, and a wobble plate mechanism mounted about a drive shaft connectable to a rotary drive source, i.e., a vehicle engine, connected to the pistons to cause reciprocating motion of the pistons and capable of changing the wobble angle thereof, a first communication passageway providing a fluid communication between the crankcase chamber and the discharge chamber, a first control valve for closing and opening the first passageway in response to a change in a suction pressure of the refrigerant, a second communication passageway for permitting evacuation of a blowby gas from the crankcase chamber to the suction chamber, and a second control valve changing an extent of opening of the second communication passageway in response to a change in a fluid pressure within the discharge chamber with respect to a predetermined pressure level.

8 Claims, 4 Drawing Figures

VARIABLE DISPLACEMENT WOBBLE PLATE TYPE COMPRESSOR WITH IMPROVED CRANKCASE PRESSURE CONTROL SYSTEM

BACKGROUND OF THE INVENTION

1. Field of the Invention

The present invention relates generally to a variable displacement wobble plate type compressor provided with a variable angle wobble plate mechanism housed in a crankcase and a built-in type wobble angle control valve arrangement capable of automatically changing a compressor displacement in response to a change in a refrigerating load in an air-conditioning system in which the variable displacement wobble plate type compressor is accommodated. More particularly, it relates to a crankcase pressure control system incorporated in a variable displacement wobble plate type compressor for maintaining a fluid pressure in the crankcase at a level at which a smooth change is made in a wobble angle of the wobble plate mechanism when a refrigerating load is low.

2. Description of the Related Art

A pending U.S. patent application No. 856,760 of the same assignee as the present patent application, filed on Apr. 28, 1986, now U.S. Pat. No. 4,685,866 discloses a variable displacement wobble plate type compressor with an improved wobble angle control unit by which a smooth return of the wobble plate from the least inclined position thereof to a fully inclined position is attained. The compressor disclosed in the pending U.S. patent application No. 856,760 can be operated at a wide displacement range i.e., from the extremely small displacement state to the full displacement state, and therefore, the compressor can be operated so that the compressor displacement is always set at an optimum condition in accordance with a change in the refrigerating load applied to the air-conditioning system. The inventors of the present application have continued their investigation into the performance of a wobble angle control unit of a variable displacement wobble plate type compressor on the basis of the control unit of the pending U.S. patent application No. 856,760. As a result, the present inventors of the present application succeeded in contriving another wobble angle control unit of a variable displacement wobble plate type compressor, which unit is definitely different from that disclosed in the pending U.S. patent application No. 856,760, and functions to enable a smooth change in a wobble angle of the wobble plate mechanism from a larger wobble angle position thereof, that is, an inclined position of the wobble plate to the least wobble angle position, i.e., an erect position of the wobble plate when the compressor displacement must be decreased in response to a reduction in the refrigerating load or a reduction in a discharge pressure of the refrigerant from the compressor due to lowering of the environmental temperature.

SUMMARY OF THE INVENTION

An object of the present invention is, therefore, to provide a variable displacement wobble plate type compressor with an improved crankcase pressure control system by which a fluid pressure in the crankcase is maintained at a level at which a smooth change in a wobble angle of the wobble plate to the smallest inclined position thereof from a larger inclined position thereof is realized when a refrigerating load is small or when the discharge pressure of the compressor is decreased due to drop in the environmental temperature, whereby the compressor is capable of positively decreasing a displacement thereof to the smallest displacement condition thereof.

Another object of the present invention is to provide a variable displacement wobble plate type compressor wherein the displacement thereof can be changed over a wide range, i.e., from a very small displacement to a large displacement.

In accordance with the present invention, there is provided a variable displacement wobble plate type compressor comprising: a suction chamber for a refrigerant before compression; a plurality of cylinder bores arranged so as to surround an axial drive shaft and having therein associated reciprocatory pistons disposed so as to draw the refrigerant from the suction chamber and to then discharge the refrigerant after compression into a discharge chamber; a crankcase having defined therein a chamber communicating with the cylinder bores and containing therein a drive plate mounted in such a manner that it is capable of rotating with the drive shaft as well as changing an inclination thereof with respect to the axial drive shaft and a non-rotating wobble plate held by the drive shaft; a plurality of connecting rods between the wobble plate and the pistons; a first passageway means for fluidly communicating the chamber of the crankcase with the discharge chamber; a first valve means arranged in the first passageway means, for opening and closing the first passageway means; a second passageway means for providing a fluid communication between the chamber of the crankcase and the suction chamber; a second valve means arranged in the second passageway means, for varying an opening area of a part of the second passageway means; a first valve control means for controlling the operation of the first valve means in response to a change in fluid pressure in the suction chamber with respect to a first predetermined pressure level, said first valve control means moving the first valve means to a first position opening the first passageway means when pressure in the chamber of the crankcase is less than the first predetermined pressure level, and to a second position closing the first passageway means when the pressure in the chamber of the crankcase is larger than the first predetermined pressure level, and a second valve control means for controlling the operation of the second valve means in response to a change in fluid pressure in the discharge chamber with respect to a second predetermined pressure level, said second valve control means moving the second valve means to a first position increasing the opening area of the part of the second passageway means when the pressure in the discharge chamber is larger than the second predetermined pressure level, and to a second position decreasing the opening area of the part of the second passageway means when the pressure in the discharge chamber of the crankcase is not larger than the second predetermined pressure level.

BRIEF DESCRIPTION OF THE DRAWINGS

Other objects, features and advantages of the present invention will be made more apparent from the ensuing description of the embodiments of the present invention with reference to the accompanying drawings, wherein.

DESCRIPTION OF THE PREFERRED EMBODIMENTS

Figure 1:
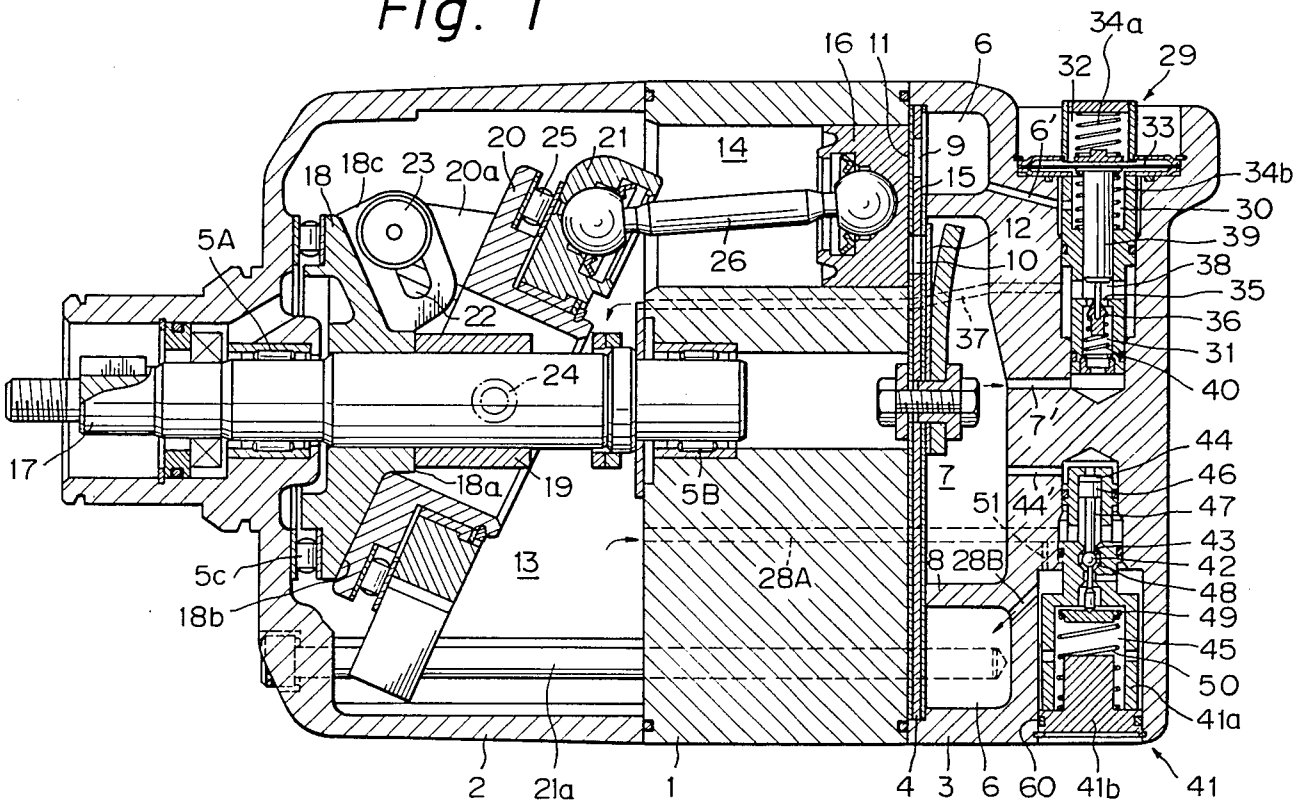
FIG. 1 is a vertical cross-sectional view of a variable displacement wobble plate type compressor with a crankcase pressure control unit according to a first embodiment of the present invention.

The constitutions and operation of embodiments of the present invention will now be described with reference to the accompanying drawings. It should be noted that, throughout the drawings FIGS. 1 through 4 illustrating first and second embodiments of the present invention, identical and like parts or elements are designated by the same reference numerals.

Figure 3:
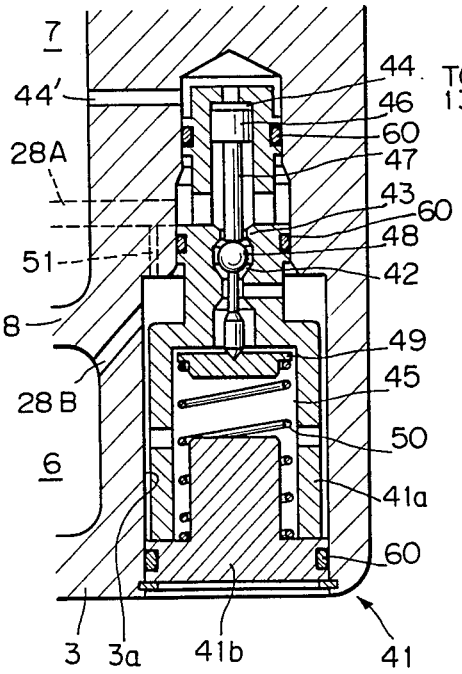
FIG. 3 is an enlarged cross-sectional view of a second valve and a valve control unit incorporated therein, of the compressor of FIG. 1; and, FIG. 4 is an enlarged cross-sectional view of a different second valve and a valve control unit incorporated therein, of a variable displacement wobble plate type compressor according to a second embodiment of the present invention.

Referring to FIGS. 1 and 3, illustrating the first embodiment of the present invention, a variable displacement wobble plate type compressor applicable to an air-conditioning system of a vehicle has a cylinder block 1 in the shape of a cylindrical member having axially spaced front and rear open ends. The open front end of the cylinder block 1 is closed by a front housing or crankcase 2 in the shape of a bell-jar, and the rear open end thereof is closed by a cap-like rear housing 3, via a valve plate 4. The front housing 2 is centrally provided with a bearing portion 5A for rotatably supporting one end of a later-described drive shaft 17. The other end of the drive shaft 17 is rotatably supported by a bearing portion 5B provided for the center of the cylinder block 1. The rear housing 3 is formed therein with an outer suction chamber 6 and an inner discharge chamber 7. The suction and discharge chambers 6 and 7 are concentric with one another, and are isolated from one another by an annular partition wall 8. The suction chamber 6 is fluidly communicatable with a later-described compression chamber 15 of each of a plurality of cylinder bores 14 formed in the cylinder block 1, via one of suction ports 9 of the valve plate 4. The discharge chamber 7 is also fluidly communicatable with the compression chamber 15 of each of the cylinder bores 14, via one of discharge ports 10 of the valve plate 4. Also, the suction and discharge chambers 6 and 7 are connected with an external refrigerating circuit of the air-conditioning system through an inlet port (not shown) and an outlet port (not shown), respectively. The above-mentioned suction port 9 of the valve plate 4 is closed by a suction valve 11 which is opened when an associated piston 16 carries out a suction stroke thereof in the cylinder bore 14. The discharge port 10 is closed by a discharge valve 12 which is opened when the associated piston 16 carries out a compression stroke thereof in the cylinder bore 14. The cylinder bores 14 of the cylinder block 1 are circumferentially arranged so as to surround the bearing portion 5B. In each of the cylinder bores 14, the afore-mentioned piston 16 is slidably and reciprocally fitted so as to define the afore-mentioned compression chamber 15 on the rear side of the cylinder block 1. Thus, the compression chamber 15 is alternately communicated with the afore-mentioned suction chamber 6 and discharge chamber 7 via suction and discharge ports 9 and 10 in response to the reciprocating motion of the piston 16.

The front housing (crankcase) 2 has therein a cylindrical crank chamber 13 which is communicated with all of the cylinder bores 14 of the cylinder block 1. The crank chamber 13 receives therein the afore-mentioned drive shaft 17 axially arranged in the chamber 17 between the above-mentioned pair of bearing portions 5A and 5B. An outer end of the drive shaft 17 is outwardly extended beyond the front end of the front housing 2 so that it is connectable to a vehicle engine (not shown) via an appropriate transmission unit and a clutch device. On the drive shaft 17 is mounted a drive element 18, referred to as a lug plate throughout the first and second embodiments of the present invention. The lug plate 18 having a generally round configuration is rotatably held by a thrust bearing 5C against a front inner wall of the crankcase 2 and is able to rotate with the drive shaft 17. The lug plate 18 is provided, on its inner end, with an end face **18*a* with which a later-described sleeve element 19 is able to come in contact during the large displacement operation of the compressor. The lug plate 18 is also provided, around the end face 18*a*, with an inclined end face 18*b* with which a drive plate 20 is able to come in contact during the wobbling thereof, and a support arm 18*c* for supporting the drive plate 20. The support arm 18*c* and the inclined end face 18*b* are arranged so as to be circumferentially spaced apart from one another by an angle of approximately 180 degrees. The drive plate 20 formed as an annular member enclosing the drive shaft 17 is supported by the support arm 18*c* so that it is able to wobble about an axis perpendicular to the axis of the drive shaft 17. The support arm 18*c* is formed with an arcute hole 22 of which the center of curvature passes through points where a later-described wobble plate 21 and connecting rods 26 are connected together via ball and socket joints during the rotation of the lug plate 18. On the other hand, the drive plate 20 has a bracket 20*a* extending toward and mated with the support arm 18*c* of the lug plate 18. The bracket 20*a* and the support arm 18*c* are operatively connected together by means of a guide pin 23 fixed to the bracket 20*a* and movably engaged within the arcute hole 22 of the support arm 18*c* so that the drive plate 20 is permitted to wobble against the lug plate 18 while rotating with the drive shaft 17. That is, the drive plate 20 is able to wobble so as to incline with respect to a plane perpendicular to the axis of the drive shaft 17. The sleeve element 19, which is slidably mounted on the drive shaft 17, is connected to the drive plate 20. That is, the cylindrical sleeve element 19 has a pair of diametrically opposed pivots 24 on which the drive plate 20 is pivotally mounted. Therefore, the sleeve element 19 slides along the drive shaft 17 in association with the wobbling motion of the drive plate 20. The drive plate 20 holds thereon a non-rotating wobble plate 21 by means of a thrust bearing 25. The wobble plate 21 is permitted to carry out only a wobbling motion together with the drive plate 20 and is formed as an annular element enclosing the drive shaft 17. The non-rotating wobble plate 21 is operatively connected with the afore-mentioned respective piston 16 by means of respective connecting rods 26 and ball and socket joints provided on both ends of each connecting rod 26. At this stage, it should be noted that the connections between the wobble plate 21 and respective pistons 16 are established in such a manner that each of the pistons 16 is brought to the top dead center position (i.e., the rearmost position in each cylinder bore 14) by the wobble plate 21 via the associated connecting rod 26 when the support arm 18***c* of the lug plate 18 is rotated to a position where the support arm 18*c* is in axial alignment with each of the cylinder bores 14. The wobbling motion of the non-rotating wobble plate 21 is guided by a guide pin 21*a* fixedly and axially extended through the front housing 2, cylinder block 1, and the rear housing 3.

The rear housing 3 is provided with a control valve 29 (hereinafter referred to as a first control valve 29) for controlling a pressure level within the crank chamber 13 thereby changing the wobble angle of the drive and wobble plates 20 and 21. The first control valve 29 includes a suction pressure chamber 30 and a discharge pressure chamber 31 arranged in axial alignment but isolated from one another. The suction pressure chamber 30 is communicated with the suction chamber 6 via a connecting passageway 6', while the discharge pressure chamber 31 is communicated with the discharge chamber 7 via a connecting passageway 7'. The suction pressure chamber 30 is further isolated from an atmospheric pressure chamber 32 communicated with the atmosphere, by means of a diaphragm member 33. The atmospheric pressure chamber 32 is positioned above the suction pressure chamber 30, and contains a spring 34*a* constantly urging the diaphragm member 33 toward the deflected position (toward the discharge pressure chamber 31). Arranged in the suction pressure chamber 30 is a return spring 34*b* to apply an adjusted return force to the diaphragm member 33. A circular valve seat 35 is formed at one end of the discharge pressure chamber 31 adjacent to a port 38 formed between the suction and discharge pressure chambers 30 and 31. The port 38 is communicated with the crank chamber 13 by means of a passageway 37 to supply the crank chamber 13 with a discharge pressure. The discharge pressure supply passageway 37 is extended from the port 38 through the rear housing 3 and the cylinder block 1.

The afore-described diaphragm member 33 is connected to one end of a valve rod 39 having the other end thereof extending into the discharge pressure chamber 31 through the port 38 and the valve port 35, and connected to a conical valve element 36 (see FIG. 2) movable with the rod 39 toward and away from the valve port 35. The movement of both valve rod 39 and valve element 36 is caused by the deflection and return of the diaphragm member 33 against the spring force of a spring 40 housed in the discharge pressure chamber 31. That is, the spring 40 urges the valve element 36 so as to close the valve port 35.

The cylinder block 1 and the rear housing 3 are formed with fluid passageways 28*a* and 28*b* extending between the suction chamber 6 on the rear housing 3 and the crank chamber 13 of the front housing 2 so as to provide a fluid communication between both chambers 6 and 13. That is, the fluid passageways 28*a* and 28*b* are provided as relief passageways for delivering a high pressure gas of the crank chamber 13 toward the suction chamber 6. In a midway of the two serial fluid passageways 28*a* and 28*b*, there is provided another control valve 41 (hereinafter referred to as a second control valve 41) which is able to operate so as to control the communication between the two fluid passageways 28*a* and 28*b*. A later-described fixed passageway 51 is formed for providing a fixed communication between the two passageways 28*a* and 28*b*.

The second control valve 41 has a valve housing 41*a* which defines therein a valve chamber 42 communicating between the above-mentioned passageways 28*a* and 28*b* and a valve seat 43. The valve housing 41*a* is fitted in a bore 3*a* formed in the rear housing 3, and the bore 3*a* is hermetically sealed from the atmosphere by means of a seal member 60 fitted in a plug element 41*b*, and is fluidly communicated with the fluid passageways 28*a* and 28*b*. A ball valve 48 is arranged in the valve chamber 42 so as to be moved toward and away from the valve seat 43. Within the valve housing 41*a*, there are also provided a discharge pressure chamber 44 and a suction pressure chamber 45 axially spaced from one another via the valve chamber 42. The suction pressure chamber 45 is constantly communicated with the suction chamber 6, via radial holes of the valve housing 41*a* and the above-mentioned passageway 28*b*. Within the suction pressure chamber 45, an axially movable support rod 49 for supporting the ball valve 48 and a spring 50 are arranged. The spring 50 has one end seated on the plug element 41*b* and the other end seated against the support rod 49 so as to constantly urge the support rod 49 and the ball valve 48 toward the valve seat 43. On the other hand, the discharge pressure chamber 44 is always communicated with the discharge chamber 7 via a communication passageway 44'. The discharge pressure chamber 44 receives therein an axially movable piston 46 having a piston rod 47 which is provided with an outer end extending axially through the valve seat 43 so as to be capable of pressing and moving the ball valve 48 in the direction away from the valve seat 43, i.e., in the direction for increasing a fluid communication between the passageways 28*a* and 28*b*. It should be noted that the fixed passageway 51 provides a fixed communication between the two passageways 28*a* and 28*b*.

The operation of the variable displacement wobble plate type compressor according to the first embodiment will be described hereunder.

Figure 2:
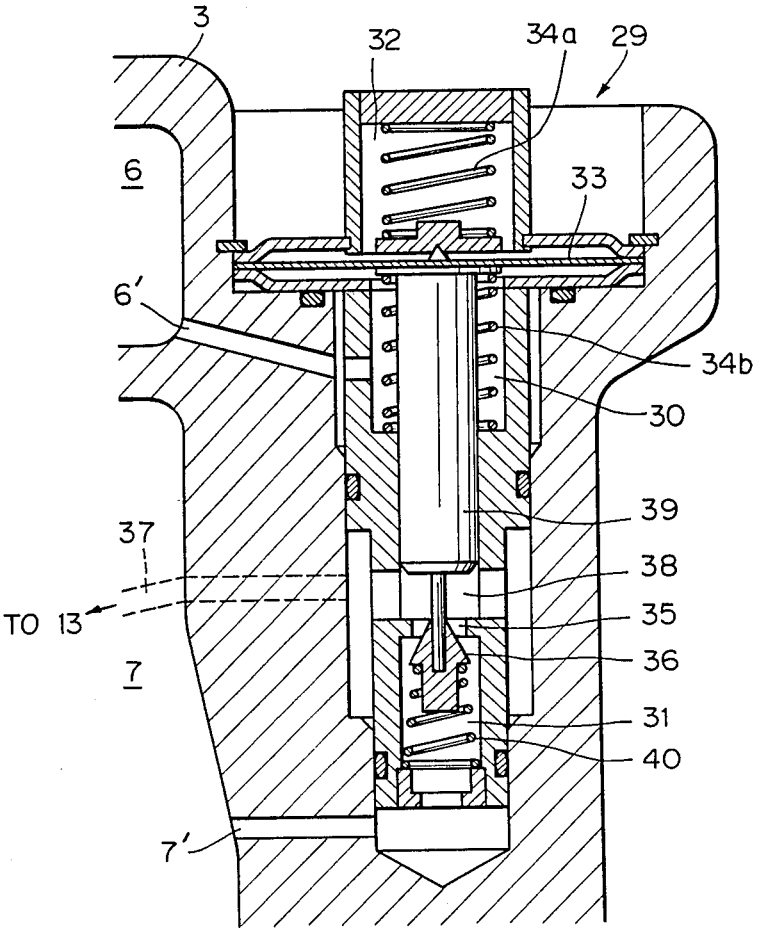
FIG. 2 is an enlarged cross-sectional view of a first valve and a valve control unit incorporated therein, of the compressor of FIG. 1.

With the first embodiment shown in FIGS. 1 through 3, when the operation of compressor is stopped, the pressures in the suction chamber 6, the discharge chamber 7, and the crankcase chamber 13 are usually balanced at a level higher than a preset pressure level corresponding to the atmospheric pressure plus a pressure exerted by the spring 34*a* in the atmospheric chamber 32 of the first control valve 29. Therefore, a high pressure of the crankcase 13, i.e., a high pressure of the suction chamber 6, prevails in the suction pressure chamber 30 of the first control valve 29. Accordingly, the diaphragm member 33 is deflected toward the atmospheric pressure chamber 32 against the atmospheric pressure and the pressure of the spring 34*a*, so as to move the valve element 36 toward the valve seat 35. Consequently, the fluid communication between the crankcase chamber 13 and the discharge pressure chamber 31 of the first control chamber 29 is interrupted due to closing of the valve seat 35 by the valve element 36. That is, the pressure of the crankcase chamber 13 is maintained at a level equal to that of the suction chamber 6, and accordingly, the pressure of the crankcase chamber 13 is applied to the back face of each piston 16. Thus, the drive and wobble plates 20 and 21 are stopped at a large inclined position.

The above-mentioned balanced pressure condition among the suction chamber 6, and discharge pressure condition 7, and the crankcase chamber 13 also brings about a closed condition of the valve seat 43 of the second control valve 41. This is because the support rod 49 and the ball valve 48 are urged against the valve seat 43 by the pressure of the spring 50 in the suction pressure chamber 45. As a result, the passageways 28*a* and 28*b* are communicated with one another only by the fixed passageway 51. That is, the smallest fixed amount of fluid communication is established between the crankcase chamber 13 and the suction chamber 6.

When the operation of the compressor is started by connecting the drive shaft 17 to the vehicle engine via a clutch device, such as a conventional solenoid clutch, rotation of the drive plate 20 is begun. At this stage, if a cooling load required for air-conditioning the vehicle compartment is large, the rotation of the drive plate 20 is carried out while maintaining the large wobble angle thereof. Accordingly, the wobble plate 21 is also maintained at the large wobble angle, and the pistons 16 connected to the wobble plate 21 carry out reciprocating motions within the associated cylinder bores 14 at a large reciprocating stroke. As a result, the large displacement operation of the compressor takes place.

During the continuation of the large displacement operation of the compressor, the discharge pressure within the discharge chamber 7, and accordingly, within the discharge pressure chamber 44 of the second control valve 41, gradually increases. When the discharge pressure level comes above the level of the combination of the suction pressure and the pressure exerted by the spring 50 in the suction pressure chamber 45, a resultant pressure difference causes the downward movement of the piston 46 and the valve rod 47 of the second control valve 41 so that the ball valve 48 is moved away from the valve seat 43. That is, the crankcase chamber 13 is communicated with the suction chamber 6, via the opened valve seat 43 and the valve chamber 42. While the compressor carries out a large displacement operation, a large amount of refrigerant containing therein a sufficient amount of lubricating oil component is circulated through the refrigerating circuit including the compressor. Therefore, in the compressor, the refrigerant drawn into the cylinder bores 14 of the cylinder block 1 applies a high sealing effect between the walls of the cylinder bores 14 and the circumferences of the pistons 16, restricting the flow of the blowby gas from the compression chambers 15 of the cylinder bores 14 to the crankcase chamber 13. As a result, due to the sufficient fluid communication between the crankcase chamber 13 and the suction chamber 6 established by means of the second control valve 41, the blowby gas in the crankcase chamber 13 can immediately flow through the passageways 28*a* and 28*b* into the suction chamber 6. Accordingly, the pressure level of the discharge chamber 13 can be maintained at a predetermined pressure level set by the pressure of the suction chamber 6 and the spring force of the spring 50.

By the continuation of the large displacement operation of the compressor for an appropriate period of time, the vehicle compartment to be air-conditioned is cooled, and the cooling load (the thermal load applied to the evaporator of the air-conditioning system) is reduced. In response to a reduction in the cooling load, the suction pressure of the refrigerant sent from the evaporator into the suction chamber 6 of the compressor is lowered. When the suction pressure of the suction chamber 6 becomes lower than a set pressure level of the first control valve 29, i.e., a pressure level corresponding to the combination of the atmospheric pressure and a pressure exerted by the spring 34, the diaphragm member 33 is returned from the reflected position toward the suction pressure chamber 30 by a pressure difference between the suction pressure of the suction chamber 6 and the set pressure of the first control valve 29, until the valve element 36 is moved away from and opens the valve port 35. As a result, the discharge chamber 31 of the first control valve 29 is fluidly communicated with the discharge pressure supply passageway 37. Accordingly, the compressed refrigerant having a high discharge pressure is supplied from the discharge chamber 7 to the crankcase chamber 13 so that the pressure level in the crankcase chamber 13 is increased. Consequently, the increased pressure in the crankcase chamber 13 acts on the back face of each piston 16 and decreases the piston stroke of each piston 16. The decrease in the piston stroke of the pistons 16 causes a reduction in the wobbling angle of the drive and wobble plates 20 and 21. Thus, the compressor displacement is gradually reduced. However, with regard to the second control valve 41, the pressure in the discharge pressure chamber 44 is still maintained at a level higher than that in the suction pressure chamber 45, and the fluid communication between the crankcase chamber 13 and the suction chamber 6 is maintained by way of the two passageways 28*a* and 28*b*, and the opened valve seat 43.

The continuation of the operation of the compressor further cools the vehicle compartment, and reduces a thermal load applied to the evaporator of the air-conditioning system. As a result, the suction pressure of the refrigerant drawn into the suction chamber 6 of the compressor from the outside circuit is reduced. The reduction in the suction pressure of the refrigerant causes a reduction in the pressure level of the suction pressure chamber 30 of the first control valve 29 while maintaining the opening of the valve port 35 of the first control valve 29. Thus, the supply of the high discharge pressure from the discharge chamber 7 to the crankcase chamber 13 continues. Accordingly, the wobble angle (the angle of inclination from the erected position of the wobble plate 21) of the drive and wobble plates 20 and 21 in the crankcase chamber 13 is forcibly decreased, so that a small displacement operation of the compressor is obtained.

When the small displacement operation of the compressor continues, the discharge pressure of the compressor gradually decreases (the reduction of the discharge pressure of the compressor also occurs due to lowering of the environmental temperature.).

While the small displacement operation of the compressor is carried out, when the pressure level of the discharge pressure chamber 44 of the second control valve 41 falls below the pressure level of the suction pressure chamber 45, i.e., the combination of the suction pressure and the pressure exerted by the spring 50, the support rod 49 and the ball valve 48 are moved toward the valve seat 43 so as to close the opening of the valve seat 43. As a result, the communication between the passageways 28*a* and 28*b* by way of the valve chamber 42 is interrupted. That is, only the fixed passageway 51 provides a fluid communication between the crankcase chamber 13 and the suction chamber 6 while permitting a limited amount of the blowby gas to escape from the crankcase chamber 13 into the suction chamber 6. Thus, an increase in the pressure within the crankcase chamber 13 by the blowby gas flowing out of respective cylinder bores 14 is achieved. This ensures that the pressure within the crankcase chamber 13 is maintained at a level necessary for moving the drive plate 20 as well as the wobble plate 21 from a large wobble angle condition (a large displacement operation of the compressor) to the erect position thereof (the smallest displacement operation of the compressor).

Figure 4:
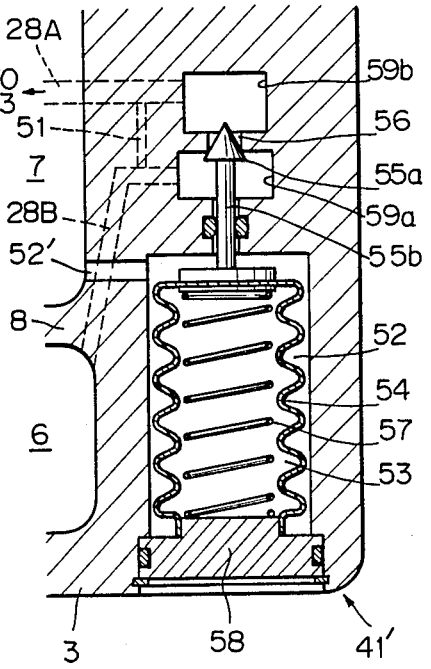

Referring now to FIG. 4, which illustrates a second control valve 41' according to a second embodiment of the present invention to be accommodated in a variable displacement wobble plate type compressor, the second embodiment is different from the first embodiment of FIG. 3 in that the second control valve 41' operates so as to directly control a fluid communication between the two passageways **28*a* and 28*b* in response to a change in the discharge pressure in the discharge chamber 7 of the compressor. That is, the second control valve 41' has a discharge pressure chamber 52 hermetically formed in the rear housing 3 and a bellows member 54 which has therein an atmospheric pressure chamber 53 communicating the atmosphere. The discharge pressure chamber 52 is always in fluid communication with discharge chamber 7 via a communication passageway 52'. The bellows member 54 is connected at one end thereof to a plug element 58 and at the other end to a conical valve element 55*a* via a slidably movable valve rod 55*b*. The conical valve element 55*a* opens or closes a valve port 56 which is formed between a suction pressure chamber 59*a* and a crankcase pressure chamber 59*b* in the rear housing 3 of the compressor. Within the atmospheric pressure chamber 53 is arranged a spring 57 always urging the bellows member 54 to the extended position whereat the conical valve element 55*a* is pressed against and closes the valve port 56. When the discharge pressure comes above a predetermined level approximately corresponding to the combination of the atmospheric pressure and the pressure exerted by the spring 57, the bellows member 54 is contracted while moving the conical valve element 55*a* away from the valve port 56. Thus, the valve port 56 is opened so as to establish an increased fluid communication between the crankcase chamber 13 and the suction chamber 6 of the compressor. The fixed passageway 51 always provides a fixed amount of fluid communication between the crankcase chamber 13 and the suction chamber 6. Thus, the second control valve 41' of the second embodiment is able to control an extent of the fluid communication between the crankcase chamber 13 and the suction chamber 6 in response to a change in the discharge pressure of the discharge chamber 7** of the compressor.

From the foregoing description of the first and second preferred embodiments of the present invention, it will be understood that, in a variable displacement wobble plate type compressor according to the present invention, the extent of a fluid communication between the crankcase chamber and the suction chamber is controlled in response to a change in the discharge pressure of the compressor with respect to a predetermined level. That is, when the discharge pressure level is higher than the predetermined level, the extent of the fluid communication between the crankcase chamber and the suction chamber is increased, permitting the high pressure fluid in the crankcase to smoothly escape into the suction chamber. While when the discharge pressure level is below the predetermined level, the extent of the fluid communication between the crankcase chamber and the suction chamber is decreased so that the pressure level in the crankcase chamber is maintained at an adequate level due to the suppression of the escape of the blowby gas from the crankcase chamber into the suction chamber. Therefore, the crankcase pressure level is sufficient to move the drive and wobble plates toward the smallest inclination position thereof (the erect position) when the refrigerating load is low or when the discharge pressure of the compressor is lowered by the low environmental temperature around the compressor. Consequently, the compressor is able to vary the displacement thereof in accordance with a refrigerating load applied to the compressor.

We claim:

1. A variable displacement wobble plate type compressor comprising:

a housing element having therein a suction chamber for a refrigerant before compression and a discharge chamber for a refrigerant after compression;

a cylinder block defining therein a plurality of cylinder bores arranged so as to surround an axial drive shaft and having therein associated reciprocatory pistons disposed so as to draw the refrigerant from said suction chamber and to then discharge the compressed refrigerant into said discharge chamber;

a crankcase having defined therein a chamber communicating with said cylinder bores and containing therein a drive plate mounted in such a manner that it is capable of rotating with said drive shaft as well as changing an inclination thereof with respect to said drive shaft and a non-rotating wobble plate held by said drive plate;

a plurality of connecting rods connecting between said wobble plate and said pistons;

a first passageway means for fluidly communicating said chamber of said crankcase with said discharge chamber of said housing element;

a first valve means arranged in said first passageway means, for opening and closing said first passageway means;

a second passageway means for providing a fluid communication between said chamber of said crankcase and said suction chamber of said housing element;

a second valve means arranged in said second passageway means, for varying an extent of opening of a part of said second passageway means;

a first valve control means for controlling an operation of said first valve means in response to a change in fluid pressure in said suction chamber with respect to a first predetermined pressure level, said first valve control means moving said first valve means to a first position opening said first passageway means when pressure in said suction chamber is less than said first predetermined pressure level, and to a second position closing said first passageway means when pressure in said suction chamber is larger than said first predetermined pressure level; and a second valve control means for controlling an operation of said second valve means in response to a change in fluid pressure in said discharge chamber with respect to a second predetermined pressure level, said second valve control moving said second valve means to a first position increasing the extent of opening of said part of said second passageway means when pressure in said discharge chamber is larger than said second predetermined pressure level, and to a second position decreasing the extent of opening of said part of said second passageway means when pressure in said discharge chamber is not larger than said second predetermined pressure level, said second valve control means including fluid passageway means for providing fluid communication between said discharge chamber and said second valve control means to sense a change in a discharge pressure in the discharge chamber.

2. A variable displacement wobble plate type compressor according to claim 1, further comprising a third fixed passageway means for providing a constantly throttle communication between said suction chamber and said chamber of said crankcase.

3. A variable displacement wobble plate type compressor, according to claim 1, wherein said first valve means comprises:

a cylindrical hollow valve body built in said housing element;

a diaphragm member arranged in said cylindrical hollow valve body so as to define in said valve body an atmospheric chamber and a suction pressure chamber communicated with said suction chamber of said housing element, said diaphragm member being moved in response to a change in a suction pressure of said refrigerant before compression;

a spring element arranged in said atmospheric pressure chamber for urging said diaphragm member under a predetermined spring bias, and;

a valve rod element movably arranged in said cylindrical hollow valve body, and having a first end connected to said diaphragm member and a second end provided with a valve element for opening and closing said first passageway means in response to a movement of said valve rod.

4. A variable displacement wobble plate type compressor according to claim 1, wherein said second valve means comprises:

a valve housing having a discharge pressure chamber communicated with said discharge chamber of said housing element, and a valve port located in said part of said second passageway means;

a piston member fitted in said discharge pressure chamber of said valve housing;

a valve element movably arranged in said valve housing and cooperating with said piston member and said valve port so as to change the extent of opening of said part of said second passageway means;

a suction pressure chamber defined in said valve housing and communicated with said suction chamber of said housing element, said suction pressure chamber receiving therein a support rod supporting said valve element;

a spring element arranged in said suction pressure chamber and constantly urging said valve element and said support rod toward said valve port under a predetermined spring bias.

5. A variable displacement wobble plate type compressor according to claim 4, wherein said second valve means is built in a part of said housing element.

6. A variable displacement wobble plate type compressor according to claim 4, wherein said valve element is a ball valve.

7. A variable displacement wobble plate type compressor according to claim 1, wherein said second valve means comprises:

a discharge pressure chamber hermetically formed in said housing element and communicated with said discharge chamber of said housing element;

a bellows member arranged in said housing element and defining therein an atmospheric changer communicating the atmosphere;

a valve port formed in said part of said second passageway means;

a valve element having a valve rod connected to said bellows member, said valve element being movable toward and away from said valve port in response to an extension and contraction of said bellows member, and;

a spring element arranged in said atmospheric pressure chamber and urging said bellows member to an extended position thereof against a discharge pressure prevailing in said discharge pressure chamber.

8. A variable displacement wobble plate type compressor, according to claim 6, wherein said valve element has a conical configuration cooperable with said valve port having a shape of a round through-hole.

* * * * *